US008302568B2

(12) United States Patent
Lee et al.

(10) Patent No.: US 8,302,568 B2
(45) Date of Patent: Nov. 6, 2012

(54) VARIABLE COMPRESSION RATIO APPARATUS FOR VEHICLE ENGINE

(75) Inventors: Jae Sang Lee, Suwon (KR); Ki Wook Byeon, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 624 days.

(21) Appl. No.: 12/512,699

(22) Filed: Jul. 30, 2009

(65) Prior Publication Data

US 2010/0132672 A1 Jun. 3, 2010

(30) Foreign Application Priority Data

Dec. 2, 2008 (KR) ..... 10-2008-0121485

(51) Int. Cl.
*F02B 75/04* (2006.01)

(52) U.S. Cl. ..... 123/48 R; 123/78 R

(58) Field of Classification Search ..... 123/48 B, 123/48 R, 48 A, 78 R, 78 AA, 78 A, 78 B, 123/78 BA, 78 E, 196 R, 196 CP
See application file for complete search history.

(56) References Cited

U.S. PATENT DOCUMENTS 1,406,886 A * 2/1922 Nuta ..... 123/78 B
2,897,804 A * 8/1959 Crooks ..... 123/48 R
3,185,138 A * 5/1965 Druzynski ..... 123/48 R
3,185,139 A * 5/1965 Thuesen ..... 123/90.26
3,405,697 A * 10/1968 Marchand ..... 123/78 R
4,031,868 A * 6/1977 Karaba et al. ..... 123/78 B
4,406,256 A * 9/1983 Akkerman ..... 123/78 E
4,784,093 A * 11/1988 Pfeffer et al. ..... 123/78 B
4,785,790 A * 11/1988 Pfeffer et al. ..... 123/78 B
5,178,103 A * 1/1993 Simko ..... 123/48 B
5,605,120 A * 2/1997 Hedelin ..... 123/78 C
6,408,804 B1 * 6/2002 Rao et al. ..... 123/48 B
6,497,203 B1 * 12/2002 Rao et al. ..... 123/48 B
6,499,446 B1 * 12/2002 Rao et al. ..... 123/48 B
6,701,885 B2 * 3/2004 Klomp et al. ..... 123/197.4
6,736,091 B1 * 5/2004 Tibbles ..... 123/78 E
6,966,282 B2 * 11/2005 Hirano ..... 123/48 B
2006/0096810 A1 * 5/2006 Eto et al. ..... 184/6.5

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A variable compression ratio apparatus for a vehicle engine that is mounted at the engine receiving combustion force of an air-fuel mixture from a piston and rotating a crankshaft mounted between upper and lower cylinder blocks, and that changes compression ratio of the air-fuel mixture by changing a mounting height of the crankshaft according to a driving condition of the engine, may include a bearing having a hollow space eccentric to a center thereof and rotatably mounted between the upper and lower cylinder blocks, the crankshaft being rotatably inserted in the hollow space; and an operating unit provided at the lower cylinder block and controlling a rotational displacement of the bearing.

14 Claims, 7 Drawing Sheets

VARIABLE COMPRESSION RATIO APPARATUS FOR VEHICLE ENGINE

CROSS-REFERENCE TO RELATED APPLICATION

The present application claims priority to Korean Patent Application No. 10-2008-0121485 filed on Dec. 2, 2008, the entire contents of which are incorporated herein for all purposes by this reference.

BACKGROUND OF THE INVENTION

1. Field of the Invention

The present invention relates to a vehicle engine. More particularly, the present invention relates to a variable compression ratio apparatus that changes compression ratio of an air-fuel mixture in a combustion chamber according to a driving condition of the engine.

2. Description of Related Art

Generally, thermal efficiency of combustion engines increases as the compression ratio thereof increases, and if ignition timing is advanced to some degree, thermal efficiency of spark-ignition engines increases.

However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine.

The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

Currently, diesel engines achieve low-temperature combustion by enlarging the volume of a combustion chamber and by lowering the compression ratio in order to meet intensified exhaust gas regulations.

However, since startability at a cold temperature deteriorates as the compression ratio decreases, a glow plug system must be made of ceramic materials so as to strengthen them and an additional control unit for controlling the glow plug system is required. Thus, production costs may increase.

In addition, since the compression ratio is fixed, an optimal compression ratio according to a various driving conditions may not be achieved.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus for a vehicle engine having advantages of enhancing fuel mileage and output as a consequence of changing compression ratio of an air-fuel mixture according to a driving condition of an engine.

In an aspect of the present invention, the variable compression ratio apparatus for a vehicle engine that is mounted at the engine receiving combustion force of an air-fuel mixture from a piston and rotating a crankshaft mounted between upper and lower cylinder blocks, and that changes compression ratio of the air-fuel mixture by changing a mounting height of the crankshaft according to a driving condition of the engine, may include a bearing having a hollow space formed eccentric to a center thereof and rotatably mounted between the upper and lower cylinder blocks, the crankshaft being rotatably inserted in the hollow space, and an operating unit provided at the lower cylinder block and coupled to the bearing so as to control a rotational displacement of the bearing.

The bearing may include an upper bearing rotatably mounted at the upper cylinder block, and a lower bearing formed asymmetric to the upper bearing, and rotatably mounted at an upper portion of a mounting recess formed at the lower cylinder block, wherein the upper bearing and the lower bearing are separately formed.

At least one oil groove for flowing oil therethrough may be formed respectively at interior and exterior circumferences of respective upper and lower bearings, and at least one oil hole may be formed in the lower bearing and/or the upper bearing so as to communicate the at least one oil groove therebetween.

The upper bearing may be wider at a middle portion thereof and relatively narrower at both end portions thereof and the lower bearing may be narrower at a middle portion thereof and relatively wider at both end portions thereof.

The lower bearing may be provided with a protruding portion disposed in the mounting recess, wherein the protruding portion is formed with a concave rolling surface along a circumferential direction thereof, and wherein a detecting dog is mounted at the protruding portion.

A position sensor may be mounted at the mounting recess corresponding to the detecting dog, wherein the position sensor is a proximity sensor.

The operating unit may include a first hydraulic pressure valve formed at one side of the mounting recess and including a first valve rod, one end of the first valve rod being pivotally coupled to the protruding portion.

The operating unit may include a first hydraulic pressure valve mounted at one side of the mounting recess with reference to the protruding portion, and a second hydraulic pressure valve mounted at the other side of the mounting recess.

First and second valve rods contacting on the protruding portion may be mounted respectively at the first and second hydraulic pressure valves and rectilinearly move with respect to the protruding portion by a hydraulic pressure supplied to the first and second hydraulic pressure valves respectively, wherein first and second rollers rolling-contacted to the protruding portion are mounted respectively at the first and second valve rods.

The first and second hydraulic pressure valves may be respectively connected to first and second hydraulic pressure holes formed at the lower cylinder block.

The variable compression ratio apparatus may further include first and second hydraulic pressure lines respectively connected to the first and second hydraulic pressure holes so as to supply the hydraulic pressure to respective hydraulic pressure valves and to return the hydraulic pressure supplied to respective hydraulic pressure valves.

First and second hydraulic pressure control members may be mounted at respective hydraulic pressure lines so as to control the hydraulic pressure, and the first and second hydraulic pressure control members are connected to a return line for returning the hydraulic pressure supplied to respective hydraulic pressure valves.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
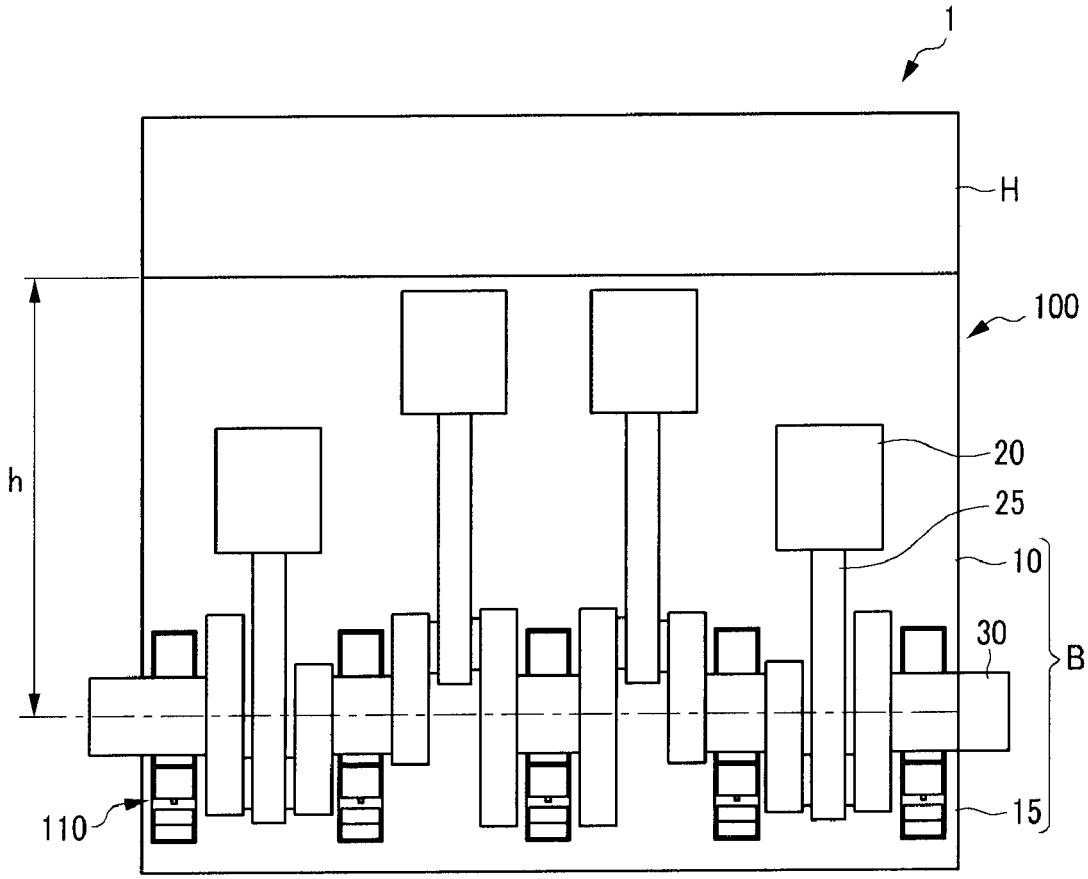
FIG. 1 is a schematic diagram of a variable compression ratio apparatus for a vehicle engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
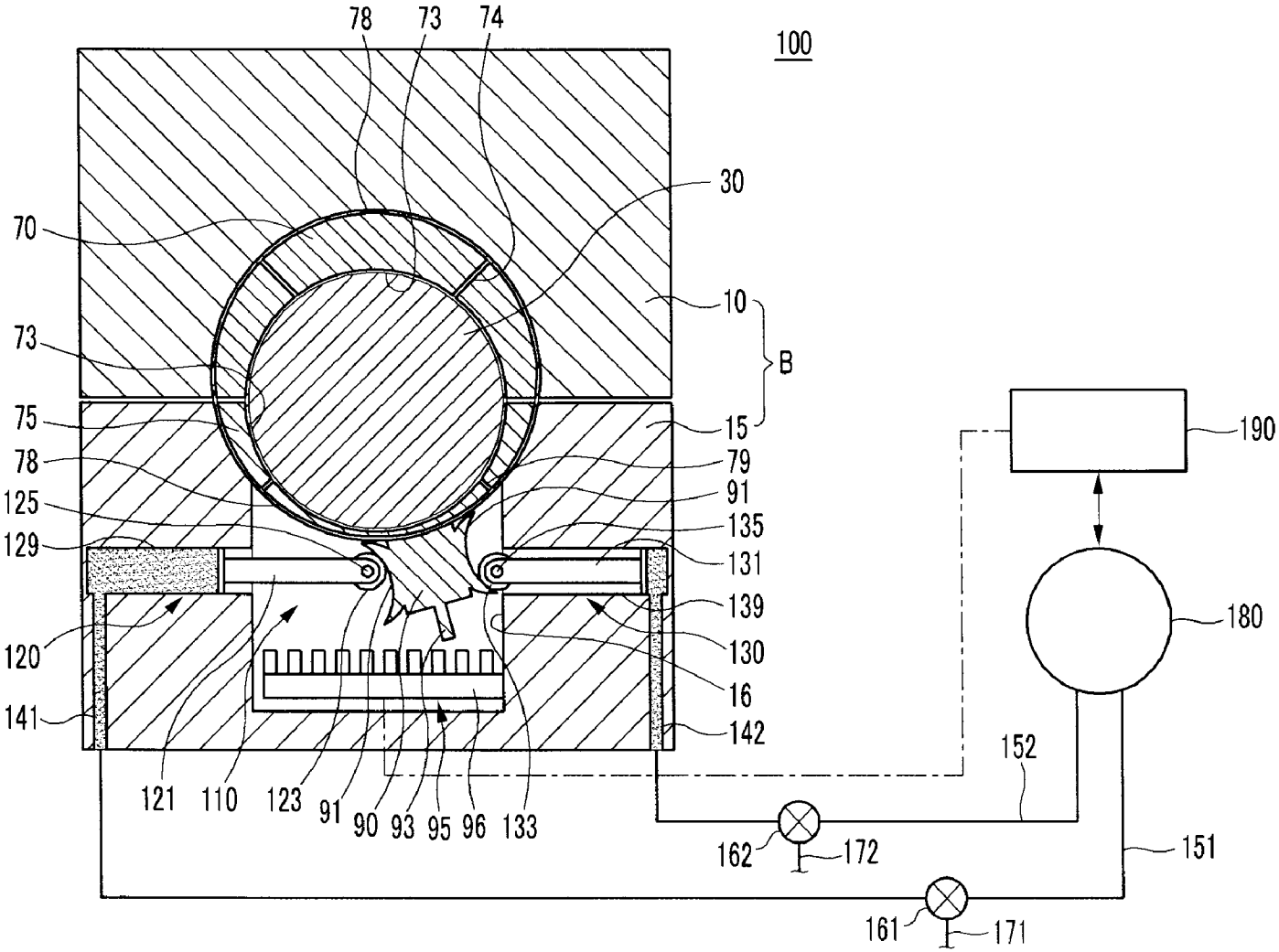
FIG. 2 is a cross-sectional view of a variable compression ratio apparatus for a vehicle engine according to an exemplary embodiment of the present invention.
Figure 3:
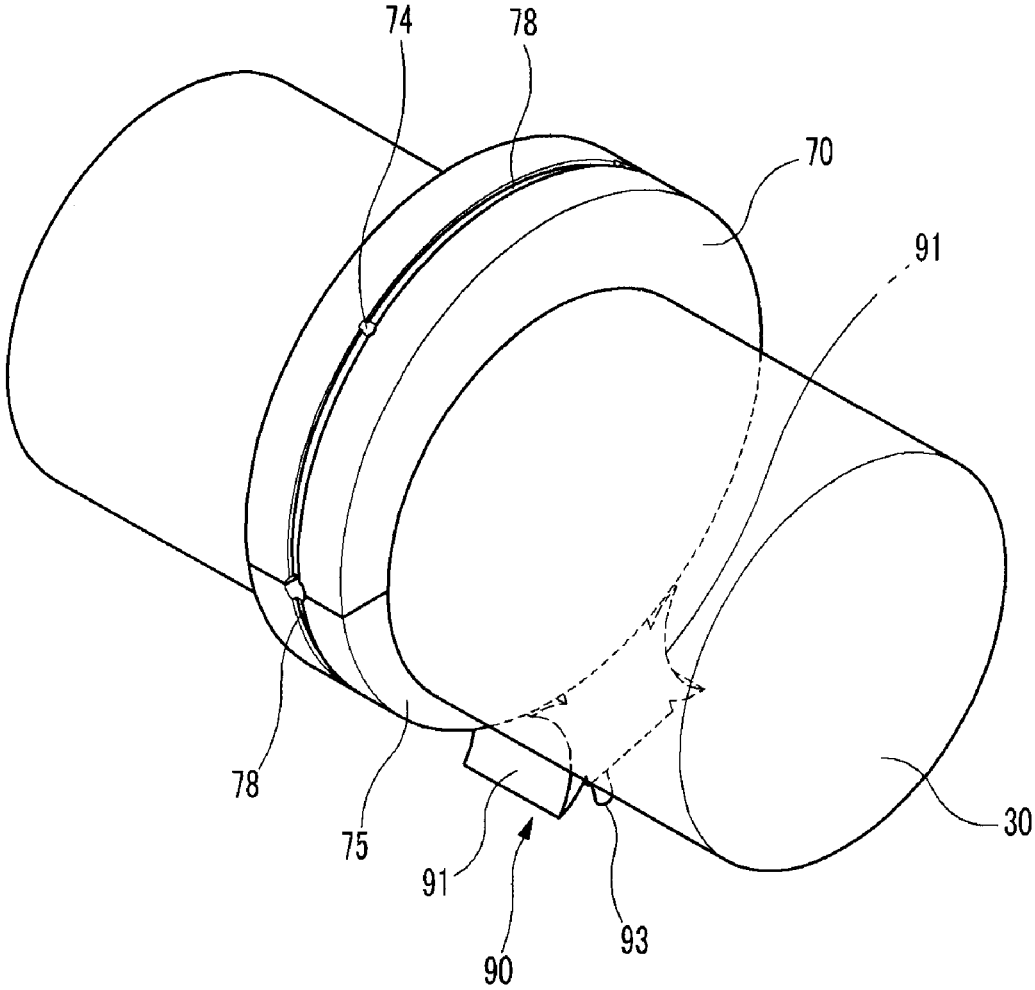
FIG. 3 is a schematic diagram showing an operation of a variable compression ratio apparatus for a vehicle engine according to an exemplary embodiment of the present invention.

FIG. 1 is a schematic diagram of a variable compression ratio apparatus for a vehicle engine according to an exemplary embodiment of the present invention; FIG. 2 is a cross-sectional view of a variable compression ratio apparatus for a vehicle engine according to an exemplary embodiment of the present invention; and FIG. 3 is a schematic diagram showing an operation of a variable compression ratio apparatus for a vehicle engine according to an exemplary embodiment of the present invention.

Referring to the drawings, a variable compression ratio apparatus 100 for a vehicle engine according to an exemplary embodiment of the present invention changes a mounting height h of a crankshaft 30 according to a driving condition of an engine 1.

The engine 1 includes a cylinder head H and a cylinder block B and the cylinder block B includes an upper cylinder block 10 and a lower cylinder block 15.

An ignition device, an intake valve, an exhaust valve, and a valve opening device are mounted at the cylinder head H.

In addition, a cylinder is formed in the engine 1, and a piston 20 is inserted in the cylinder so as to form a combustion chamber between the cylinder and the piston 20.

The combustion chamber is connected to an intake manifold so as to receive an air-fuel mixture, and is connected to an exhaust manifold so as to exhaust the burnt air-fuel mixture.

One end of a connecting rod 25 is rotatably connected to the piston 20, and the other end of the connecting rod 25 is eccentrically and rotatably connected to the crankshaft 30.

Therefore, explosion force of the air-fuel mixture transmitted from the piston 20 to the connecting rod 25 is transmitted to and rotates the crankshaft 30.

The crankshaft 30 is mounted at a connecting position of the upper cylinder block 10 and the lower cylinder block 15.

The variable compression ratio apparatus 100 according to an exemplary embodiment of the present invention is mounted in the cylinder block B of the engine 1. The variable compression ratio apparatus 100 changes compression ratio of the air-fuel mixture by changing the mounting height of the crankshaft 30 according to the driving condition of the engine 1.

The variable compression ratio apparatus 100 includes a bearing 70 and 75 and an operating unit 110, and the components will be described in detail.

According to the present exemplary embodiment, the bearing 70 and 75 reduces friction occurred when the crankshaft 30 rotates, and has a hollow cylindrical shape.

Figure 4:
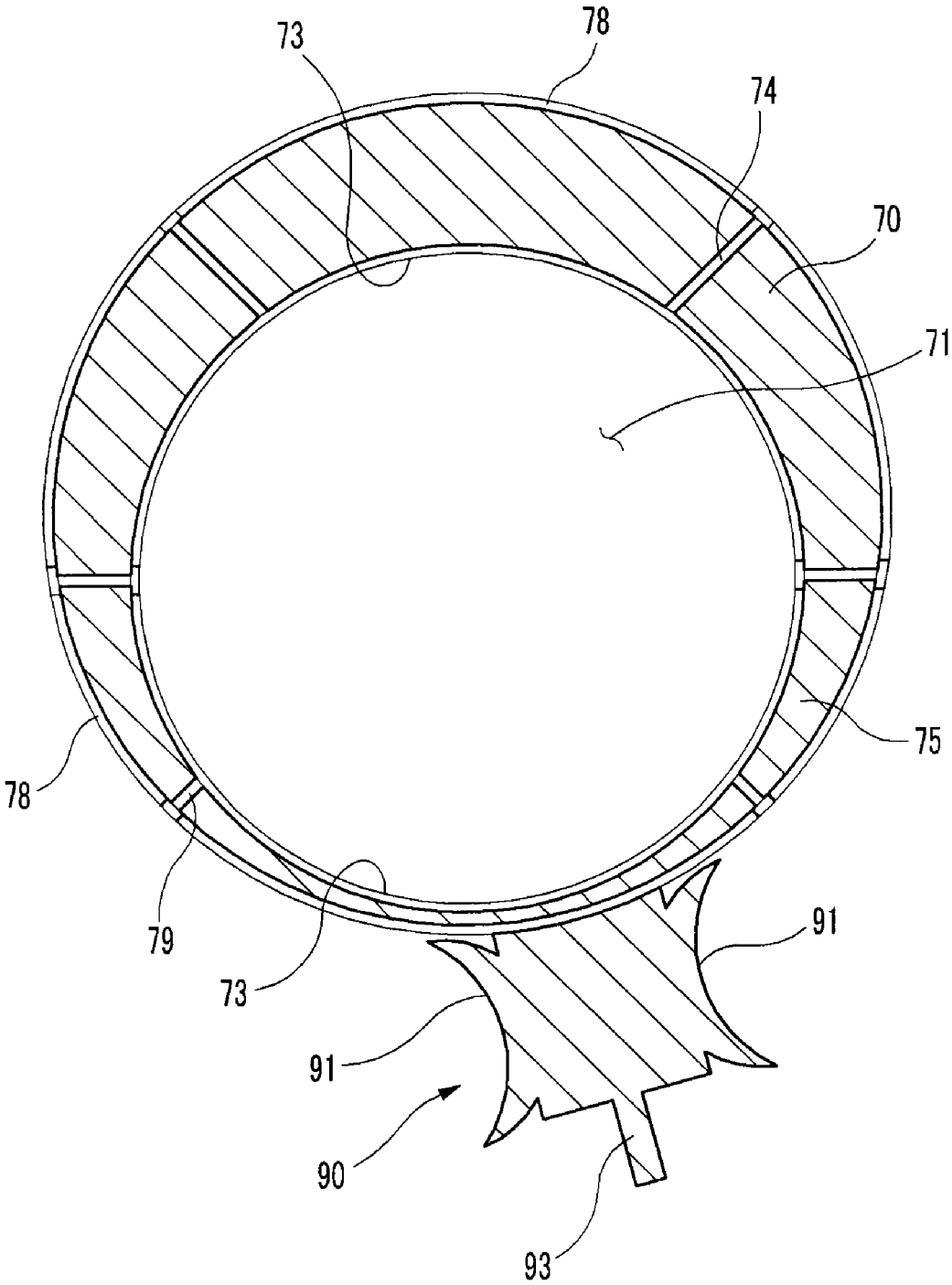
FIG. 4 is a cross-sectional view of a bearing applicable to a variable compression ratio apparatus for a vehicle engine according to an exemplary embodiment of the present invention.

The bearing 70 and 75, as shown in FIG. 4, having a hollow space 71 eccentric to a center of the bearing 70 and 75, and is rotatably mounted between the upper cylinder block 10 and the lower cylinder block 15.

That is, the center of the bearing 70 and 75 is not the same as and is apart from that of the hollow space 71.

In this case, the crankshaft 30 is rotatably inserted in the hollow space 71 of the bearing 70 and 75.

The bearing 70 and 75 includes an upper bearing 70 mounted at the upper cylinder block 10 and a lower bearing 75 mounted at an upper portion of a mounting recess 16 formed at the lower cylinder block 15.

Since the bearing 70 and 75 has the hollow space 71 eccentric to the center of the bearing 70 and 75, the upper bearing 70 and the lower bearing 75 are formed asymmetrically to each other.

That is, the upper bearing 70 is wider at the middle portion thereof and relatively narrower at both end portions thereof, and the lower bearing 75 is narrower at the middle portion thereof and relatively wider at both end portions thereof.

In the drawings, the upper bearing 70 and the lower bearing 75 are formed separately and then are assembled with each other. However, the upper bearing 70 and the lower bearing 75 may be formed monolithically according to an exemplary embodiment of the present invention.

Here, since the bearing 70 and 75 rotates between the upper and lower cylinder blocks 10 and 15 and the crankshaft 30 rotates in the hollow space 71, a lubrication pathway is formed at the bearing 70 and 75 so as to reduce the friction between the upper and lower cylinder blocks 10 and 15 and the crankshaft 30 by lubrication oil.

In this case, the lubrication pathway includes at least one oil grooves 73 and 78 formed respectively at an interior circumference and an exterior circumference of the upper and lower bearings 70 and 75 and at least one oil holes 74 and 79 formed at the oil grooves 73 and 78 so as to communicate the oil holes 74 and 79 therethrough.

Meanwhile, the lower bearing 75 is provided with a protruding portion 90 positioned in the mounting recess 16 of the lower cylinder block 15.

The protruding portion 90 is a reel-shaped, and is protruded from the exterior circumference of the lower bearing 75. A concave rolling surface 91 is formed at an exterior circumference of the protruding portion 90 circumferentially.

In addition, a detecting dog 93 for detecting a position of the bearing 70 and 75 is formed at the protruding portion 90, and is protruded downwardly from the protruding portion 90.

In addition, a position sensor 95 is mounted at the mounting recess 16 of the lower cylinder block 15 corresponding to the detecting dog 93.

The position sensor 95 includes a proximity sensor 96 which detects a position of the detecting dog 93 according to rotation of the bearing 70 and 75 and outputs the detected signal to the controller 190.

Since the position sensor 95 including the proximity sensor 96 is well known to a person skilled in the art, detailed description will be omitted in this specification.

According to the present exemplary embodiment, the operating unit 110 is provided at the lower cylinder block 15, and rotates the bearing 70 and 75 clockwise or counterclockwise by hydraulic pressure supplied through a hydraulic pump 180 of the engine 1.

The operating unit 110 includes a first hydraulic pressure valve 120 mounted at one side of the mounting recess 16 with reference to the protruding portion 90 of the lower bearing 75 and a second hydraulic pressure valve 130 mounted at the other side of the mounting recess 16.

The respective hydraulic pressure valves 120 and 130 is formed with first and second cylindrical portions 129 and 139 receiving the hydraulic pressure, and each cylindrical portions 129 and 139 is substantially connected to the hydraulic pump 180.

In addition, the cylindrical portions 129 and 139 of the first and second hydraulic pressure valves 120 and 130 are respectively connected to first and second hydraulic pressure holes 141 and 142 formed at the lower cylinder block 15.

The first and second hydraulic pressure valves 120 and 130 is respectively provided with first and second valve rods 121 and 131 that rectilinearly move with respect to the protruding portion 90 of the lower bearing 75.

The respective first and second valve rods 121 and 131 is mounted in the cylindrical portions 129 and 139, rectilinearly move to the left or to the right in the drawings by the hydraulic pressure supplied from the hydraulic pump 180.

Here, first and second rollers 123 and 133 which are rolling-contacted to the rolling surface 91 of the protruding portion 90 are mounted respectively at one ends of the first and second valve rods 121 and 131.

In this case, the respective rollers 123 and 133 reduces frictional force between the first and second valve rods 121 and 131 and the protruding portion 90.

The respective rollers 123 and 133 is rotatably engaged to the first and second valve rods 121 and 131 by engaging means such as pins 125 and 135.

First and second hydraulic pressure lines 151 and 152 are respectively connected to the first and second hydraulic pressure holes 141 and 142. The first and second hydraulic pressure lines 151 and 152 supply the hydraulic pressure received from the hydraulic pump 180 to the cylindrical portions 129 and 139, and return the hydraulic pressure supplied to the cylindrical portions 129 and 139 to an oil fan.

In addition, first and second hydraulic pressure control members 161 and 162 for controlling the hydraulic pressure are mounted at the respective hydraulic pressure lines 151 and 152.

The first and second hydraulic pressure control members 161 and 162 are operated by the controller 190, and are conventional hydraulic pressure control members that supply, cut off, and return the hydraulic pressure of the respective hydraulic pressure lines 151 and 152.

Here, first and second return lines 171 and 172 for returning the hydraulic pressure supplied to the cylindrical portions 129 and 139 of the first and second hydraulic pressure valves 120 and 130 are connected to the respective hydraulic pressure control members 161 and 162.

In another exemplary embodiment of the present invention, the variable compression ratio apparatus 100 may include only the first valve rod 121 connected to the protruding portion 90 such that the second cylindrical portion 139 and hydraulic line 152 may be removed.

Hereinafter, an operation of the variable compression ratio apparatus 100 for a vehicle engine according to an exemplary embodiment of the present invention will be described in detail.

In a case that the engine 1 operates, the controller 190 detects the driving condition of the engine 1, e.g., a fuel amount, an engine speed, and a coolant temperature through respective sensors, and determines whether the detected driving condition of the engine 1 satisfies a predetermined driving condition.

Here, the driving condition is satisfied when the coolant temperature is lower than or equal to a predetermined temperature and the engine speed is slower than or equal to a predetermined speed.

At this process, the hydraulic pump 180 receives oil stored in the oil fan and generates a target hydraulic pressure. In addition, the hydraulic pump 180 supplies the same hydraulic pressure to the first and second hydraulic pressure valves 120 and 130 through the first and second hydraulic pressure lines 151 and 152 and the first and second hydraulic pressure holes 141 and 142 (referring to FIG. 2).

In this case, supply of the hydraulic pressure is done by the hydraulic pressure control members 161 and 162 mounted at the first and second hydraulic pressure lines 151 and 152.

Since the same hydraulic pressure is supplied to the first and second hydraulic pressure valves 120 and 130, the bearing 70 and 75 does not rotate.

In addition, as shown in FIG. 2, the first valve rod 121 of the first hydraulic pressure valve 120 remains at a forwardly moving state, and the second valve rod 131 of the second hydraulic pressure valve 130 remains at a backwardly moving state.

Figure 5:
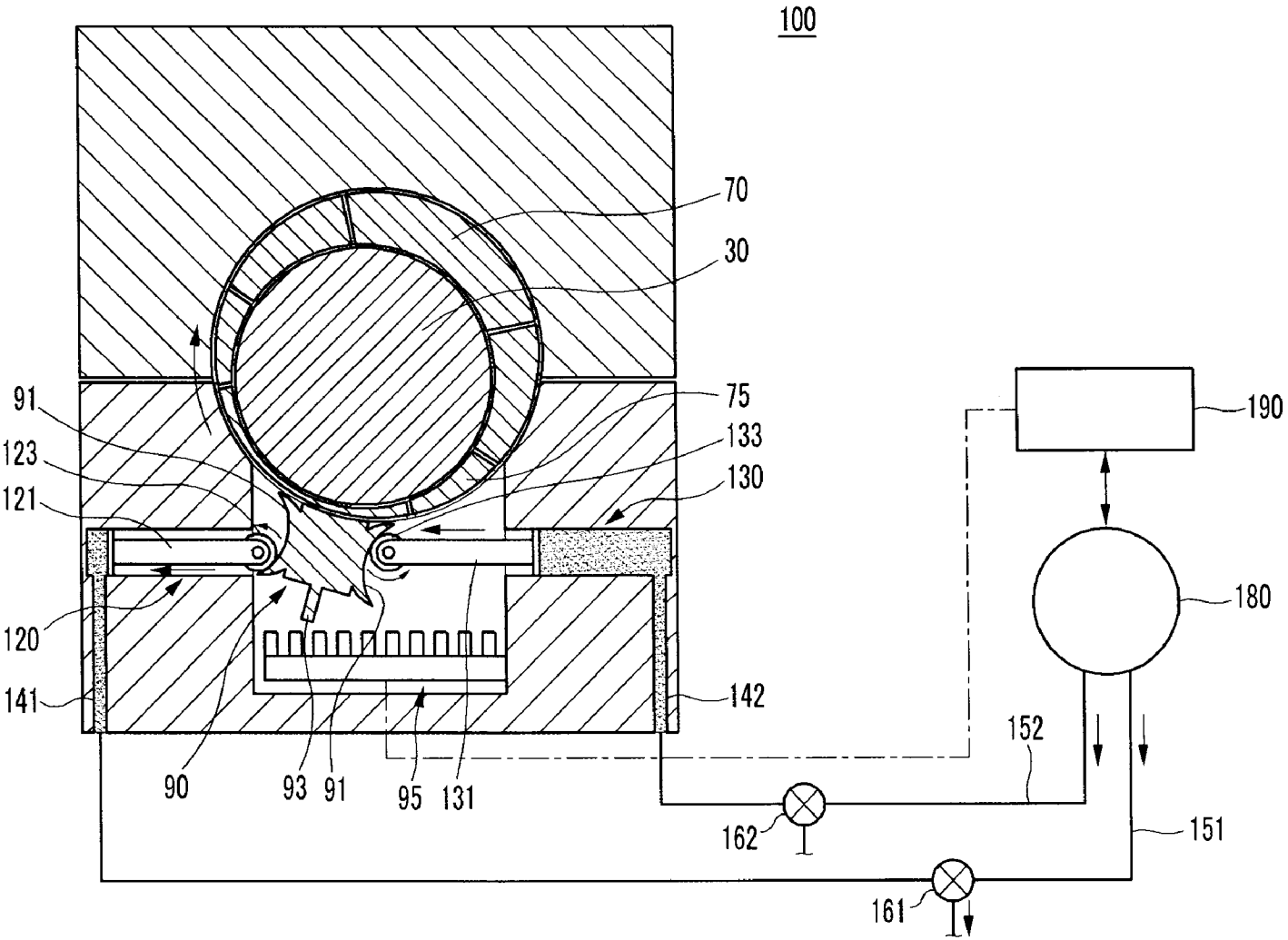
FIG. 5 to FIG. 7 are schematic diagram showing an operation of a variable compression ratio apparatus for a vehicle engine according to an exemplary embodiment of the present invention.

At this state, in a case that the driving condition of the engine 1 satisfies the predetermined driving condition, that is, the engine drives at a low-load condition (high compression ratio region), the oil supplied to the first hydraulic pressure valve 120 is returned to the oil fan through the first hydraulic pressure control member 161 and the hydraulic pressure of the first hydraulic pressure valve 120 is reduced as shown in FIG. 5.

In this case, the first valve rod 121 of the first hydraulic pressure valve 120 moves backward and the second valve rod 131 of the second hydraulic pressure valve 130 moves forward by a pressure difference between the first hydraulic pressure valve 120 and the second hydraulic pressure valve 130.

The second roller 133 rotates in a state of being contacted to the rolling surface 91 of the protruding portion 90, and the second valve rod 131 pushes the protruding portion 90 to one direction (arrow direction in FIG. 5).

Therefore, the hydraulic pressure is applied to the protruding portion 90 of the lower bearing 75 through the second valve rod 131, and the bearing 70 and 75 rotates clockwise.

At this time, the first roller 123 rotates in a state of being contacted to the rolling surface 91 of the protruding portion 90, and the first valve rod 121 supports the protruding portion 90.

Here, the position sensor 95 detects the detecting dog 93 of the protruding portion 90 and outputs the detected signal to the controller 190.

The controller 190 detects the position of the bearing 70 and 75 based on the detected signal of the position sensor 95.

In addition, the controller 190 controls the first hydraulic pressure control member 161 to supply the same hydraulic pressure as the hydraulic pressure supplied to the second hydraulic pressure valve 130 to the first hydraulic pressure valve 120 when the bearing 70 and 75 rotates to a predetermined position.

The bearing 70 and 75 does not rotate since the same hydraulic pressure is supplied to the first and second hydraulic pressure valves 120 and 130.

Figure 6:
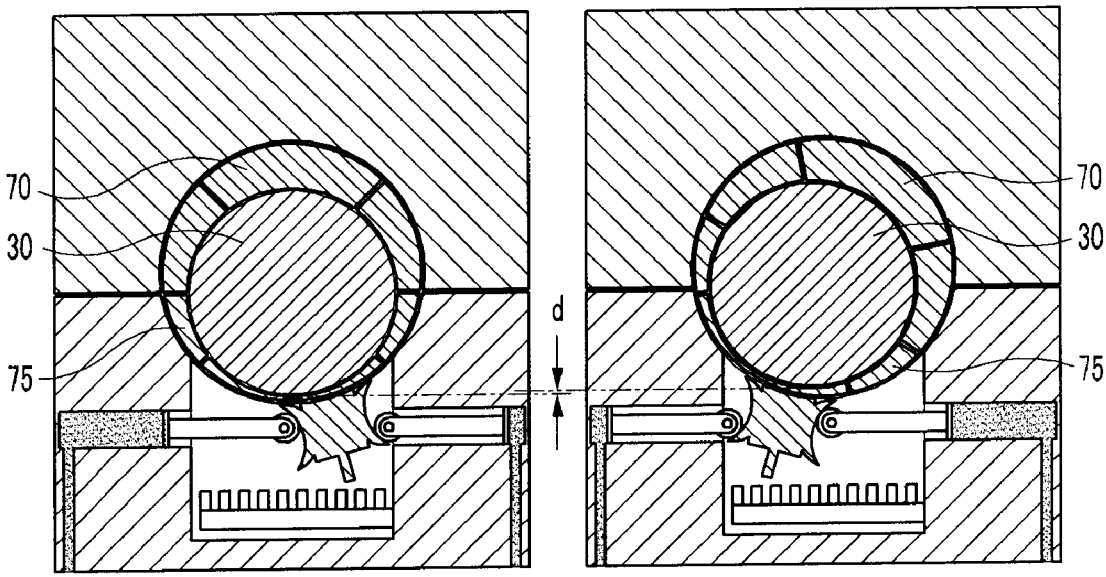

Since the bearing 70 and 75 has the hollow space 71 eccentric to the center of the bearing 70 and 75 and the crankshaft 30 is rotatably inserted in the hollow space 71 according to the present exemplary embodiment, the crankshaft 30 is raised by a predetermined height d and high compression ratio can be achieved as shown in FIG. 6, as the bearing 70 and 75 rotates clockwise.

Figure 7:
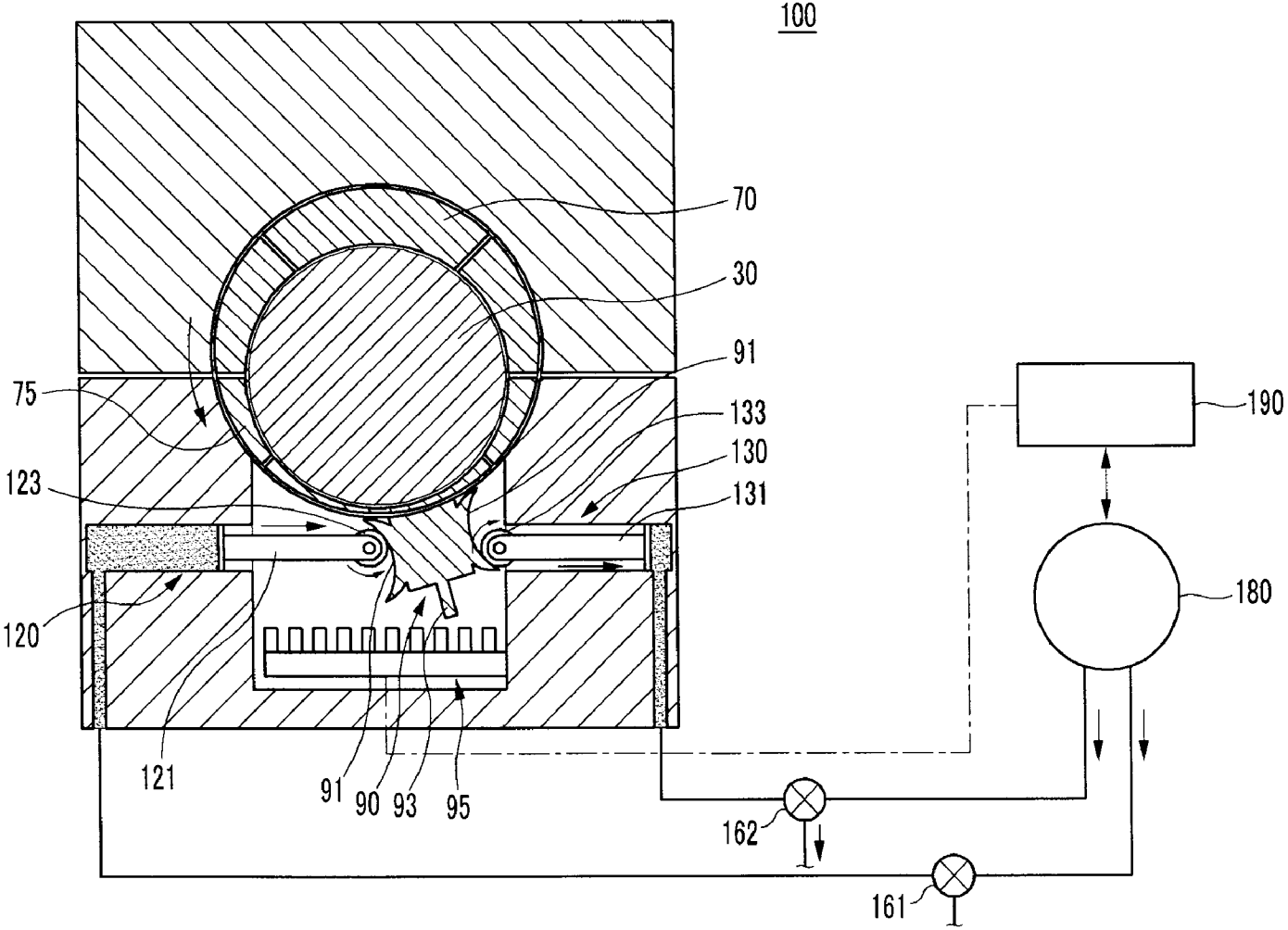

Meanwhile, if the driving condition of the engine 1 does not satisfy the predetermined driving condition, that is the engine 1 drives at a high-load condition (low compression ratio region), the oil supplied to the second hydraulic pressure valve 130 is returned to the oil fan through the second hydraulic pressure control member 162 and the hydraulic pressure of the second hydraulic pressure valve 130 is reduced as shown in FIG. 7.

In this case, the first valve rod 121 of the first hydraulic pressure valve 120 moves forward and the second valve rod 131 of the second hydraulic pressure valve 130 moves backward by the pressure difference between the first hydraulic pressure valve 120 and the second hydraulic pressure valve 130.

The first roller 123 rotates in a state of being contacted to the rolling surface 91 of the protruding portion 90, and the first valve rod 121 pushes the protruding portion 90 to the other direction (arrow direction in FIG. 7).

Therefore, the hydraulic pressure is applied to the protruding portion 90 of the lower bearing 75 through the first valve rod 121, and the bearing 70 and 75 rotates counterclockwise.

At this time, the second roller 133 rotates in a state of being contacted to the rolling surface 91 of the protruding portion 90, and the second valve rod 131 supports the protruding portion 90.

Here, the position sensor 95 detects the detecting dog 93 of the protruding portion 90 and outputs the detected signal to the controller 190.

The controller 190 detects the position of the bearing 70 and 75 based on the detected signal of the position sensor 95.

In addition, the controller 190 controls the second hydraulic pressure control member 162 to supply the same hydraulic pressure as the hydraulic pressure supplied to the first hydraulic pressure valve 120 to the second hydraulic pressure valve 130 when the bearing 70 and 75 rotates to the predetermined position.

The bearing 70 and 75 does not rotate since the same hydraulic pressure is supplied to the first and second hydraulic pressure valves 120 and 130.

Since the bearing 70 and 75 has the hollow space 71 eccentric to the center of the bearing 70 and 75 and the crankshaft 30 is rotatably inserted in the hollow space 71 according to the present exemplary embodiment, the crankshaft 30 is lowered by the predetermined height d and low compression ratio can be achieved as shown in FIG. 6, as the bearing 70 and 75 rotates counterclockwise.

As described above, since the present invention can control the compression ratio of an air-fuel mixture according to a driving condition of an engine, fuel consumption and output may be improved.

For convenience in explanation and accurate definition in the appended claims, the terms "interior", "exterior", "forward" and "backward" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus for a vehicle engine that is mounted at the engine receiving combustion force of an air-fuel mixture from a piston and rotating a crankshaft mounted between upper and lower cylinder blocks, and that changes compression ratio of the air-fuel mixture by changing a mounting height of the crankshaft according to a driving condition of the engine, the variable compression ration apparatus comprising: a bearing having a hollow space formed eccentric to a center thereof and rotatably mounted between the upper and lower cylinder blocks, the crankshaft being rotatably inserted in the hollow space; and an operating unit provided at the lower cylinder block and coupled to the bearing so as to control a rotational displacement of the bearing, wherein the bearing comprises: an upper bearing rotatably mounted at the upper cylinder block; and a lower bearing formed asymmetric to the upper bearing, and rotatably mounted at an upper portion of a mounting recess formed at the lower cylinder block; and wherein the upper bearing is wider at a middle portion thereof and relatively narrower at both end portions thereof and the lower bearing is narrower at a middle portion thereof and relatively wider at both end portions thereof; wherein the lower bearing is provided with a protruding portion disposed in the mounting recess; and wherein the operating unit comprises a first hydraulic pressure valve mounted at one side of the mounting recess with reference to the protruding portion.

2. The variable compression ratio apparatus of claim 1, wherein the upper bearing and the lower bearing are separately formed.

3. The variable compression ratio apparatus of claim 1, wherein at least one oil groove for flowing oil therethrough is formed respectively at interior and exterior circumferences of respective upper and lower bearings, and at least one oil hole is formed in the lower bearing and/or the upper bearing so as to communicate the at least one oil groove therebetween.

4. The variable compression ratio apparatus of claim 1, wherein the protruding portion is formed with a concave rolling surface along a circumferential direction thereof.

5. The variable compression ratio apparatus of claim 1, wherein a detecting dog is mounted at the protruding portion.

6. The variable compression ratio apparatus of claim 5, wherein a position sensor is mounted at the mounting recess corresponding to the detecting dog.

7. The variable compression ratio apparatus of claim 6, wherein the position sensor is a proximity sensor.

8. The variable compression ratio apparatus of claim 1, wherein the operating unit comprises a first hydraulic pressure valve formed at one side of the mounting recess and including a first valve rod, one end of the first valve rod being pivotally coupled to the protruding portion.

9. The variable compression ratio apparatus of claim 1, wherein the operating unit further comprises: a second hydraulic pressure valve mounted at the other side of the mounting recess.

10. The variable compression ratio apparatus of claim 9, wherein first and second valve rods contacting on the protruding portion are mounted respectively at the first and second hydraulic pressure valves and rectilinearly move with respect to the protruding portion by a hydraulic pressure supplied to the first and second hydraulic pressure valves respectively.

11. The variable compression ratio apparatus of claim 10, wherein first and second rollers rolling-contacted to the protruding portion are mounted respectively at the first and second valve rods.

12. The variable compression ratio apparatus of claim 9, wherein the first and second hydraulic pressure valves are respectively connected to first and second hydraulic pressure holes formed at the lower cylinder block.

13. The variable compression ratio apparatus of claim 12, further comprises first and second hydraulic pressure lines respectively connected to the first and second hydraulic pressure holes so as to supply the hydraulic pressure to respective hydraulic pressure valves and to return the hydraulic pressure supplied to respective hydraulic pressure valves.

14. The variable compression ratio apparatus of claim 13, wherein first and second hydraulic pressure control members are mounted at respective hydraulic pressure lines so as to control the hydraulic pressure, and the first and second hydraulic pressure control members are connected to a return line for returning the hydraulic pressure supplied to respective hydraulic pressure valves.

* * * * *